US009380365B2

(12) United States Patent
Okamura et al.

(10) Patent No.: US 9,380,365 B2
(45) Date of Patent: Jun. 28, 2016

(54) ACOUSTIC GENERATOR, ACOUSTIC GENERATION DEVICE, AND ELECTRONIC DEVICE

(71) Applicant: KYOCERA Corporation, Kyoto-shi, Kyoto (JP)

(72) Inventors: Takeshi Okamura, Aira (JP); Masaki Terazono, Kirishima (JP); Satoru Kamitani, Kirishima (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 14/647,965

(22) PCT Filed: Jun. 28, 2013

(86) PCT No.: PCT/JP2013/067921
§ 371 (c)(1),
(2) Date: May 28, 2015

(87) PCT Pub. No.: WO2014/097668
PCT Pub. Date: Jun. 26, 2014

(65) Prior Publication Data

US 2015/0312661 A1 Oct. 29, 2015

(30) Foreign Application Priority Data

Dec. 17, 2012 (JP) ..... 2012-275132
Dec. 21, 2012 (JP) ..... 2012-280204

(51) Int. Cl.
*H04R 1/02* (2006.01)
*H04R 17/00* (2006.01)

(Continued)

(52) U.S. Cl.
CPC .. *H04R 1/02* (2013.01); *H04R 3/00* (2013.01); *H04R 17/00* (2013.01); *H04R 1/06* (2013.01); *H04R 7/045* (2013.01)

(58) Field of Classification Search
CPC ..... H04R 2440/00–2440/07; H04R 2217/00–2217/03; H04R 9/00; H04R 7/04
USPC ..... 381/152, 190, 396, 398, 431, 433
See application file for complete search history.

(56) References Cited

U.S. PATENT DOCUMENTS 1,919,632 A * 7/1933 Haigis ..... H04R 7/16 381/152
3,614,335 A * 10/1971 Dymoke-Bradshaw . H04R 7/18 381/398

(Continued)

FOREIGN PATENT DOCUMENTS

JP 62-109600 U 7/1987
JP 2001-275190 A 10/2001

(Continued)

OTHER PUBLICATIONS

International Search Report, PCT/JP2013/067921, Sep. 17, 2013, 2 pgs.

*Primary Examiner* — Suhan Ni
(74) *Attorney, Agent, or Firm* — Volpe and Koenig, P.C.

(57) ABSTRACT

An acoustic generator according to one embodiment includes an exciter, a vibrating portion, a frame, and a lead. The exciter receives an input of an electrical signal and is caused to vibrate. The exciter is mounted on the vibrating portion, and the vibrating portion is caused to vibrate by the vibration of the exciter. The frame is provided on an external circumferential portion of the vibrating portion, and supports the vibrating portion substantially flat. The lead is connected to the exciter, and inputs an electrical signal to the exciter. The frame includes a terminal serving as a connection point to the lead.

16 Claims, 13 Drawing Sheets

(51) Int. Cl.

| | |
|---|---|
| ***H04R 3/00*** | (2006.01) |
| *H04R 1/06* | (2006.01) |
| *H04R 7/04* | (2006.01) |

(56) References Cited

U.S. PATENT DOCUMENTS

| | | | | | |
|---|---|---|---|---|---|
| 3,697,790 | A * | 10/1972 | Flint | H04R 17/00 | 381/190 |
| 4,122,314 | A * | 10/1978 | Matsuda | H04R 7/02 | 381/398 |
| 5,432,758 | A * | 7/1995 | Sone | H04R 9/00 | 381/398 |
| 7,181,040 | B2 * | 2/2007 | Ohta | H04R 1/02 | 381/396 |
| 2013/0094681 | A1 | 4/2013 | Fukuoka et al. | | |
| 2014/0314255 | A1 | 10/2014 | Fukuoka et al. | | |

FOREIGN PATENT DOCUMENTS

| | | | |
|---|---|---|---|
| JP | 2004-023436 | A | 1/2004 |
| JP | 2012-110018 | A | 6/2012 |

* cited by examiner

ACOUSTIC GENERATOR, ACOUSTIC GENERATION DEVICE, AND ELECTRONIC DEVICE

CROSS-REFERENCE TO RELATED APPLICATIONS

This application is national stage application of International Application No. PCT/JP2013/067921, filed on Jun. 28, 2013, which designates the United States, incorporated herein be reference, and which claims the benefit of priority from Japanese Patent Application No. 2012-275132, filed on Dec. 17, 2012; and Japanese Patent Application No. 2012-280204, filed on Dec. 21, 2012, the entire contents of both of which are incorporated herein by reference.

FIELD

The embodiments disclosed herein relate to an acoustic generator, an acoustic generation device, and an electronic device.

BACKGROUND

Acoustic generators using a piezoelectric element have been conventionally known (for example, see Patent Literature 1). Such an acoustic generator outputs sound by applying a voltage to a piezoelectric element mounted on a vibrating plate, thereby causing the vibrating plate to vibrate to actively use resonance of the vibration.

In addition, such an acoustic generator can be formed thin and with a light weight in comparison with common electromagnetic speakers, because a thin film such as a resin film can be used as the vibrating plate.

In the case of using a thin film as the vibrating plate, the thin film requires support in a state of being provided with uniform tension by being held in a thickness direction between, for example, a pair of frame members, to obtain excellent acoustic conversion efficiency.

CITATION LIST

Patent Literature

Patent Literature 1: Japanese Patent Application Laid-open No. 2004-023436

SUMMARY

Technical Problem

Because such a conventional acoustic generator actively makes use of the resonance of the vibrating plate provided with uniform tension, the sound pressure frequency characteristics often indicate peaks (frequencies resulting in a higher sound pressure than those achieved with nearby frequencies) and dips (frequencies resulting in a lower sound pressure than those achieved with nearby frequencies), and it has been therefore difficult to achieve high quality sound.

Solution to Problem

An acoustic generator according to an aspect of an embodiment includes an exciter, a vibrating portion, a frame, and a lead. The exciter receives an input of an electrical signal and is caused to vibrate. The exciter is mounted on the vibrating portion, and the vibrating portion is caused to vibrate by the vibration of the exciter. The frame is provided on an external circumferential portion of the vibrating portion, and supports the vibrating portion substantially flat. The lead is connected to the exciter, and inputs an electrical signal to the exciter. The frame includes a terminal serving as a connection point to the lead.

DESCRIPTION OF EMBODIMENTS

Embodiments of an acoustic generator, an acoustic generation device, and an electronic device that are disclosed by the present application will now be explained in detail with reference to the appended drawings. The embodiments described hereunder are not intended to limit the scope of the present invention in any way.

Figure 1A:
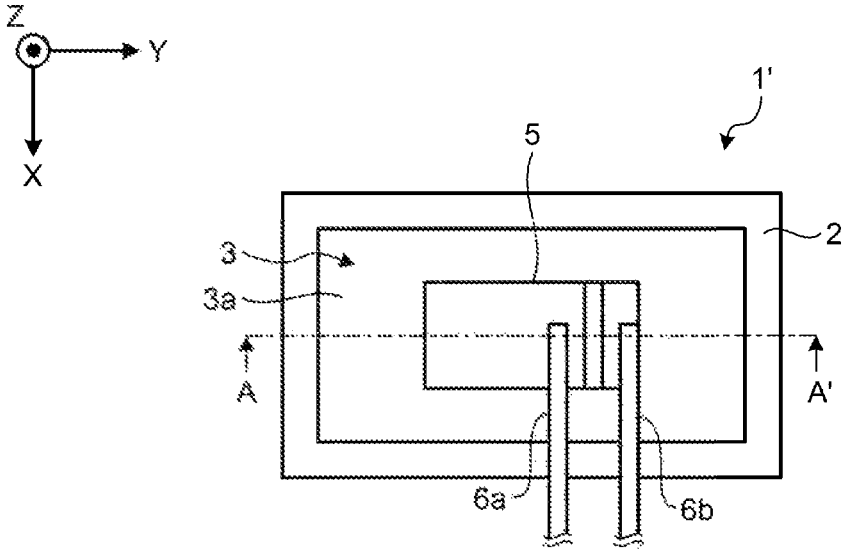
FIG. 1A is a schematic plan view of a basic acoustic generator.

Before explaining an acoustic generator 1 according to the embodiment, a general structure of a basic acoustic generator 1' will now be explained with reference to FIGS. 1A to 1C. FIG. 1A is a schematic plan view of the acoustic generator 1', FIG. 1B is a first cross sectional view along the line A-A' in FIG. 1A, and FIG. 1C is a second cross sectional view along the line A-A' in FIG. 1A.

Figure 1B:
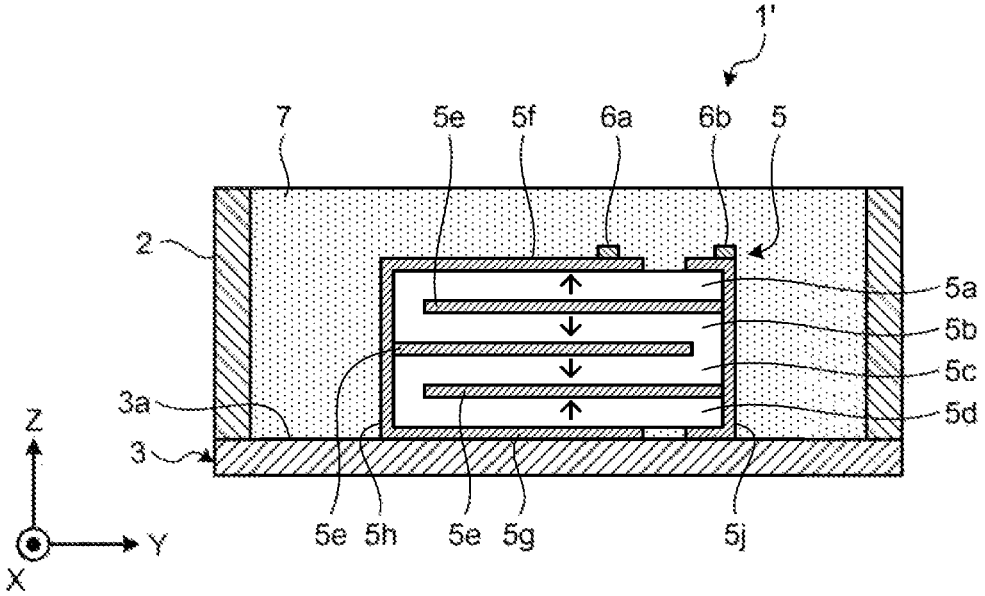
FIG. 1B is a first cross sectional view along the line A-A' in FIG. 1A.
Figure 1C:
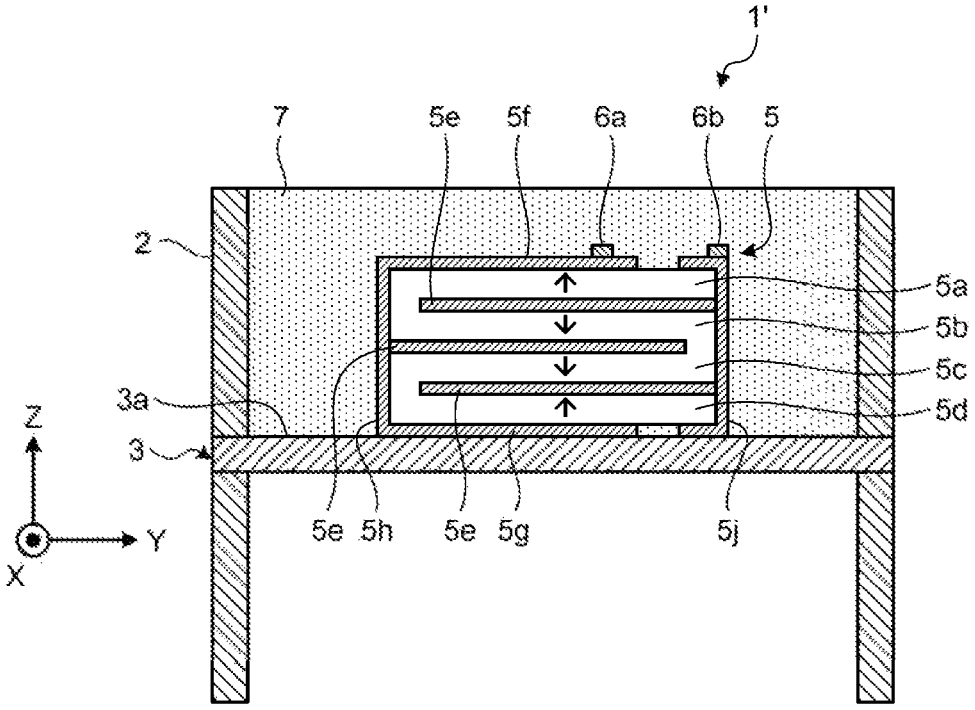
FIG. 1C is a second cross sectional view along, the line A-A' in FIG. 1A.

To facilitate understanding of the explanation, included in FIGS. 1A, 1B, and 1C is a three-dimensional Cartesian coordinate system having a Z axis the positive direction of which extends perpendicularly upwardly and the negative direction of which extends perpendicularly downwardly. This Cartesian coordinate system is included in some of the drawings referred to in the following explanation.

A resin layer 7 (described later) is omitted in FIG. 1A. Also to facilitate understanding of the explanation, illustrated in FIG. 1B and FIG. 1C is the acoustic generator 1' the thickness direction of which (Z-axial direction) is exaggeratingly enlarged.

As illustrated in FIG. 1A, the acoustic generator 1' includes a frame 2, a vibrating plate 3, a piezoelectric element 5, and lead wires 6*a* and 6*b*. Explained below is an example in which the piezoelectric element 5 is provided in singularity as illustrated in FIG. 1A, but the number of the piezoelectric element 5 is not limited to one.

As illustrated in FIG. 1B as an example, the frame 2 functions as a support for supporting the vibrating plate 3 at ends of the vibrating plate 3. The vibrating plate 3 has a plate-like or a film-like shape the ends of which are fixed by the frame 2, to be supported in a state of being substantially flat and provided with uniform tension in the frame 2.

In the example illustrated in FIG. 1C, the frame 2 has two frame members having the same rectangular, frame-like shape, and nipping the ends of the vibrating plate 3 therebetween, thereby allowing the frame 2 to serve as a support for supporting the vibrating plate 3. The vibrating plate 3 has a plate-like or a film-like shape the ends of which are nipped and fixed by the frame 2. In other words, the vibrating plate 3 is supported in a state of being substantially flat and provided with uniform tension in the frame 2.

In this case, the vibrating plate 3 can be stably stretched by nipping the vibrating plate 3 by the two frame members. This structure is better because it improves the frequency characteristics of the acoustic generator 1' to those that are durable and do not fluctuate for a long time.

The inner portion of the vibrating plate 3, being inner with respect to the internal circumference of the frame 2, and that is not nipped by the frame 2 and is capable of freely vibrating serves as a vibrating portion 3*a*. The vibrating portion 3*a* is an approximately rectangular portion that is on the inner side of one frame 2.

The vibrating plate 3 may be made of various types of materials, such as a resin or a metal. For example, the vibrating plate 3 may be a film made of a resin such as polyethylene, polyimide, and polypropylene and having a thickness of 10 micrometers to 200 micrometers. Because resin films are a material having a lower elastic modulus and a lower mechanical Q value than those of metal plates and the like, the vibrating plate 3 formed of a resin film can be bent and vibrated with a large amplitude, and enables reduction in difference between the resonance peak and the dip by increasing the width of the resonance peak and lowering the height of the resonance peak in sound pressure frequency characteristics. A composite material of a metal and a resin may be used as the vibrating plate 3.

The thickness, the material, and the like of the frame 2 are not particularly limited. The frame 2 may be made of various types of materials such as a resin or a metal. For example, the frame 2 may be preferably made of stainless steel with a thickness of 100 micrometers to 1000 micrometers, from the viewpoint of mechanical strength and high corrosion resistance.

Illustrated in FIG. 1A is the frame 2 the internal area of which has an approximately rectangular shape, but the shape may also be a polygonal shape such as a parallelogram, a trapezoid, or a regular polygon. Explained in the embodiment is an example in which the frame 2 has an approximately rectangular shape, as illustrated in FIG. 1A.

The piezoelectric element 5 is provided by being bonded to the surface of the vibrating portion 3*a*, for example, and serves as an exciter that receives an application of a voltage and excites the vibrating portion 3*a*.

The piezoelectric element 5 includes a laminate of four piezoelectric layers 5*a*, 5*b*, 5*c*, and 5*d* that are made of ceramic and laminated alternatingly with three internal electrode layers 5*e*, surface electrode layers 5*f* and 5*g* provided on the top and the bottom surfaces ox the laminate, respectively, and external electrodes 5*h* and 5*j* provided on respective sides where the internal electrode layers 5*e* are exposed, as illustrated in FIG. 1B or FIG. 1C. To the external electrodes 5*h* and 5*j*, the lead wires 6*a* and 6*b* are connected, respectively. The lead wires 6*a* and 6*b* are leads that receive electrical signals from outside.

The piezoelectric element 5 has a plate-like shape the principal surfaces of which at the top and the bottom have a polygonal shape such as a rectangle or a square. The piezoelectric layers 5*a*, 5*b*, 5*c*, and 5*d* are polarized in the directions indicated by the arrows in FIG. 1B or 1C. In other words, the piezoelectric layers 5*a*, 5*b*, 5*c*, and 5*d* are polarized in opposite directions on one side and the other side in the thickness direction (Z-axial direction in FIG. 1B or 1C), with respect to the direction of the electric field applied at a particular moment.

When a voltage is applied to the piezoelectric element 5 via the lead wires 6*a* and 6*b*, the piezoelectric layers 5*c* and 5*d* on the side bonded on the vibrating portion 3*a* shrink, and the piezoelectric layers 5*a* and 5*b* on the top surface side of the piezoelectric element 5 stretch and deform, for example, at one particular moment. By applying an alternating-current signal to the piezoelectric element 5, the piezoelectric element 5 is caused to bend and vibrate, thereby causing the vibrating portion 3*a* to bend and vibrate.

As described above, the piezoelectric layers 5*a* and 5*b* on the top surface side of the piezoelectric element 5 and the piezoelectric layers 5*c* and 5*d* on the bottom surface side thereof exhibit stretching and shrinking behaviors conflicting each other. Consequently, the piezoelectric element 5 is caused to bend and vibrate in a bimorph manner, to apply fixed vibration to the vibrating portion 3*a* to generate sound. Because the piezoelectric element 5 is a laminated bimorph piezoelectric vibrating element and the piezoelectric element 5 itself bends and vibrates by itself, strong vibration can be generated regardless of the material of the vibrating portion 3*a*, for example, even with soft vibrating portion 3*a*, and sufficient sound pressure can be obtained with piezoelectric elements 5 of a small number.

A principal surface of the piezoelectric element 5 is bonded to a principal surface of the vibrating portion 3*a* using an adhesive such as epoxy-formed resin.

Examples of materials with which the piezoelectric layers 5*a*, 5*b*, 5*c*, and 5*d* are formed include piezoelectric ceramics that have been conventionally used such as lead zirconate titanate or lead-free piezoelectric materials such as a Bi-layered compound and a tungsten bronze structure compound.

Various types of metallic materials may be used for the internal electrode layers 5*e*. When a material with a metallic component consisting of silver and palladium, and a ceramic component used in the piezoelectric layers 5*a*, 5*b*, 5*c*, and 5*d*, for example, are included, a stress caused by the difference in the thermal expansions in the piezoelectric layers 5*a*, 5*b*, 5*c*, and 5*d* and the internal electrode layers 5*e* can be reduced, so that the piezoelectric element 5 with no defective lamination can be achieved.

The surface electrode layers 5*f* and 5*g* and the external electrodes 5*h* and 5*j* are formed of metal, such as silver, as a main component. The surface electrode layers 5*f* and 5*g* and the external electrodes 5*h* and 5*j* may contain a glass component. A glass component contained therein enables strong adhesion of the piezoelectric layers 5*a*, 5*b*, 5*c*, and 5*d* and the internal electrode layers 5*e*, to the surface electrode layers 5*f* and 5*g* or the external electrodes 5*h* and 5*j*. The content of the glass component is, for example, 20 percent by volume or less.

The lead wires 6*a* and 6*b* are an example of leads. Each of the lead wires 6*a* and 6*b* has one end connected to the piezoelectric element 5 to input as electrical signal to the piezoelectric element 5. The lead wires 6*a* and 6*b* may be made of various types of metallic materials. When the lead wires 6*a* and 6*b* are provided using flexible wiring in which a foil made of a metal such as copper or aluminum is interposed between resin films, for example, a low-profile piezoelectric element 5 can be provided.

The acoustic generator 1' also includes, as illustrated in FIG. 1B or FIG. 1C, the resin layer 7 that is provided covering the piezoelectric element 5 and the surface of the vibrating portion 3*a* on the inner side of the frame 2, and is integrated with the vibrating portion 3*a* and the piezoelectric element 5.

For the resin layer 7, a material such as an acrylic-based resin may be used, and the resin layer 7 is preferably formed in such a manner that a Young's modulus within a range from 1 megapascal to 1 gigapascal is achieved. By embedding the piezoelectric element 5 in the resin layer 7, an appropriate level of damper effect can be achieved, so that the resonance can be suppressed and the peaks and the dips in the sound pressure frequency characteristics can be reduced.

Furthermore, illustrated in FIG. 1B or FIG. 1C is an example in which the resin layer 7 is provided to the same height as the height of the frame 2, but the resin layer 7 may be provided to a height that is higher than the height of the frame 2. Conversely, the resin layer 7 may not be necessarily provided to cover the piezoelectric element 5 and the surface of the vibrating portion 3*a*. It suffices that the resin layer 7 covers the piezoelectric element 5 and at least part of the surface of the vibrating portion 3*a* on the side where the piezoelectric element 5 is disposed.

As described above, the vibrating portion 3*a*, the piezoelectric element 5, and the resin layer 7 are integrated, to form a composite vibrating portion that integrally vibrates.

Illustrated in FIG. 1B or FIG. 1C is an example in which the piezoelectric element 5 is a laminated bimorph piezoelectric element, but the piezoelectric element 5 is not limited thereto. For example, the piezoelectric element 5 may be a unimorph piezoelectric element that is a deformable piezoelectric element 5 bonded to the vibrating portion 3*a*.

As illustrated in FIG. 1A to FIG. 1C, the vibrating portion 3*a* is supported substantially flat in a state of being provided with uniform tension inside the frame 2. In such a case, because peak dips and distortions are caused by resonance induced by vibration of the piezoelectric element 5, the sound pressure steeply changes at a certain frequency, and the sound pressure frequency characteristics are not easily flattened.

Figure 2:
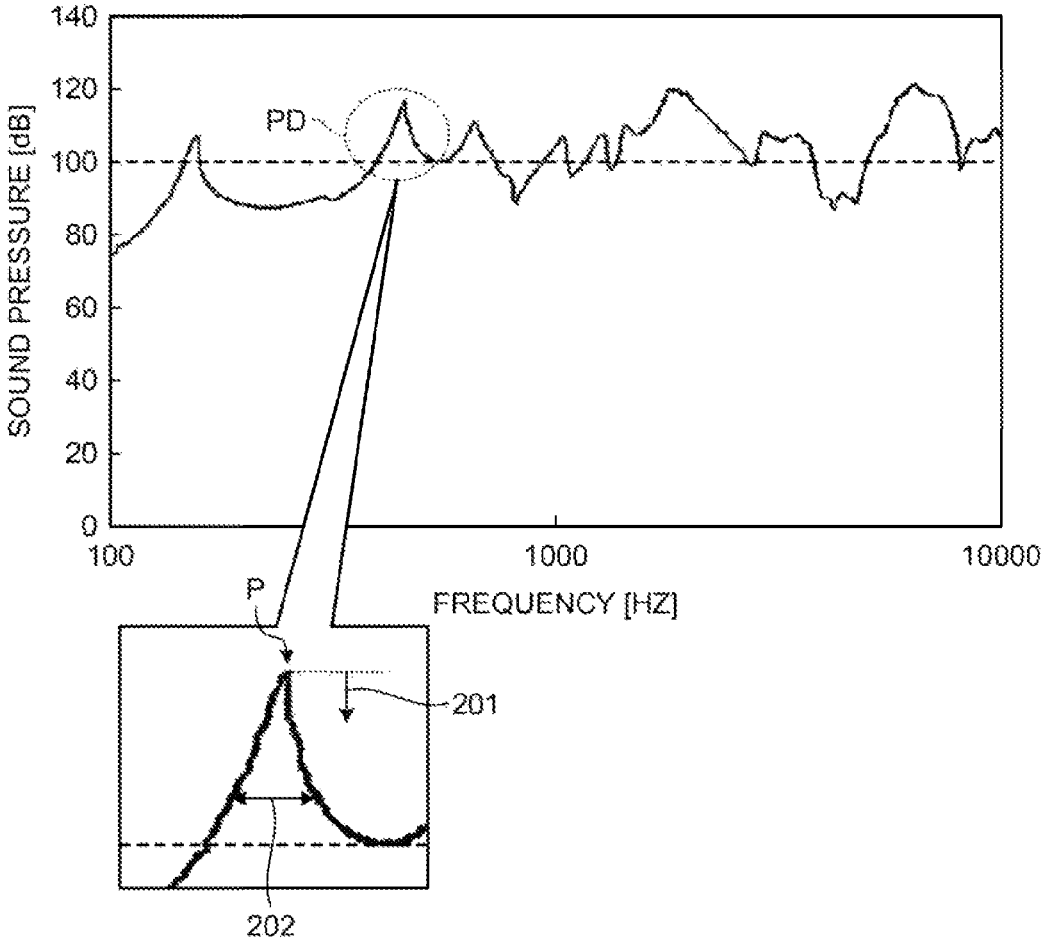
FIG. 2 is a schematic illustrating an example of sound pressure frequency characteristics.

FIG. 2 illustrates the above point. FIG. 2 is a schematic illustrating an example of sound pressure frequency characteristics. As already described in the explanation of FIG. 1A, the vibrating portion 3*a* is supported substantially flat in a state of being provided with uniform tension inside the frame 2.

In such a case, the peaks concentrate and degenerate at a certain frequency due to resonance of the vibrating portion 3*a*, so that the peaks and the dips tend to become steep and be scattered over the whole frequency regions, as illustrated in FIG. 2.

As an example, let us focus on the portion surrounded by the closed curve PD drawn with a dotted line in FIG. 2. With such a peak, the sound pressure becomes varied depending on the frequency, so that it becomes difficult to achieve high-quality sound.

In such a case, it is effective to take an approach of reducing the height of the peak P (see the arrow 201 in FIG. 2), and of increasing the peak width (see the arrow 202 in FIG. 2) so that the difference between the peak p and the dip (not illustrated) is reduced, as illustrated in FIG. 2.

The frame 2 is focused on hereunder. As described above, the frame 2 is a support that supports the vibrating portion 3*a* while uniformly applying tension to the vibrating portion 3*a*. When the vibrating portion 3*a* vibrates, the frame 2 itself also vibrates by the resonance of the vibrating portion 3*a*. The frame 2 returns reflected waves to the vibrating portion 3*a*. Accordingly, the frame 2 can be regarded as one of constituent elements of the composite vibrating portion that integrally vibrates.

For this reason, in the present embodiment, the principal surface of the frame 2 is provided with terminals serving as connecting points from the outside to the lead wires 6*a* and 6*b*, to disturb reflected waves returned from the frame 2 to the vibrating portion 3*a*, by disturbing vibrating waves around the "terminals". In this manner, the resonance frequency is made partly uneven to remove degeneration of the resonance mode and achieve distribution. In this manner, the height of the peak P is reduced, and the peak width is increased.

In addition, according to the present embodiment, the "terminals" are provided in portions shifted from the center of the side of the frame 2, to provide the whole composite vibrating portion with an asymmetrical shape and reduce symmetry of the reflected waves. With this structure, the resonance frequency is made partly uneven, to reduce the height of the peak P and increase the peak width.

The frame 2 that is made asymmetrical enables distribution of the degenerate vibration mode of the frame 2 to a plurality of resonance modes, and smoothing the peak shape of the sound pressure at the resonance frequency of the frame 2. This structure consequently reduces the difference between the resonance peak and the dip in the sound pressure frequency characteristics of the whole composite vibrating portions, and suppresses the sound pressure frequency fluctuations as much as possible, to improve the sound quality. In particular, when an electrical signal is input to the "terminals", the degenerate vibration mode can be further distributed, because the temperature of the frame 2 changes in the vicinity of the "terminals" and causes expansion and contraction to cause distortion of the frame 2.

Figure 3A:
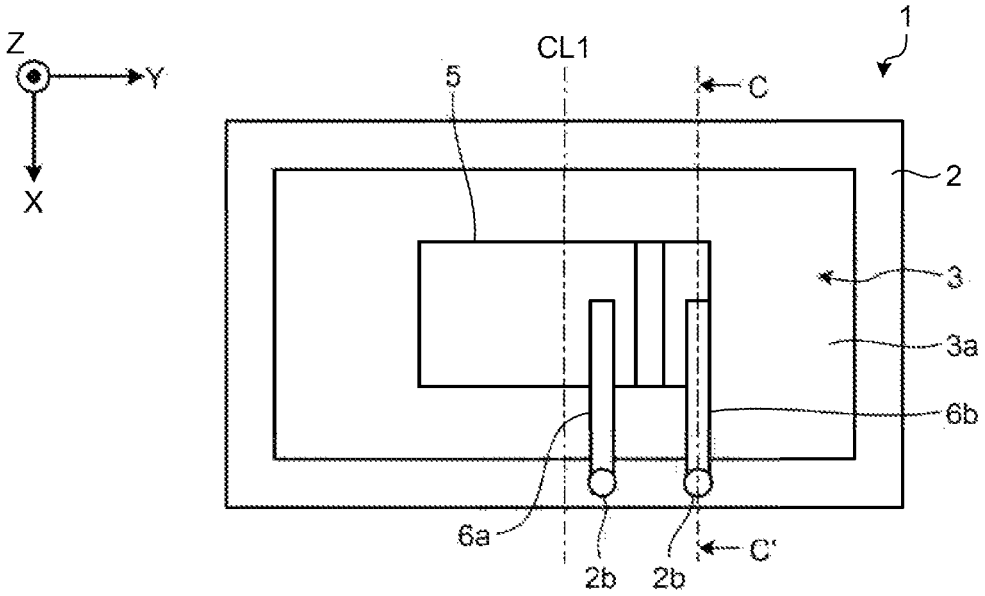
FIG. 3A is a first schematic plan view illustrating an example of a structure of an acoustic generator according to one embodiment.
Figure 3B:
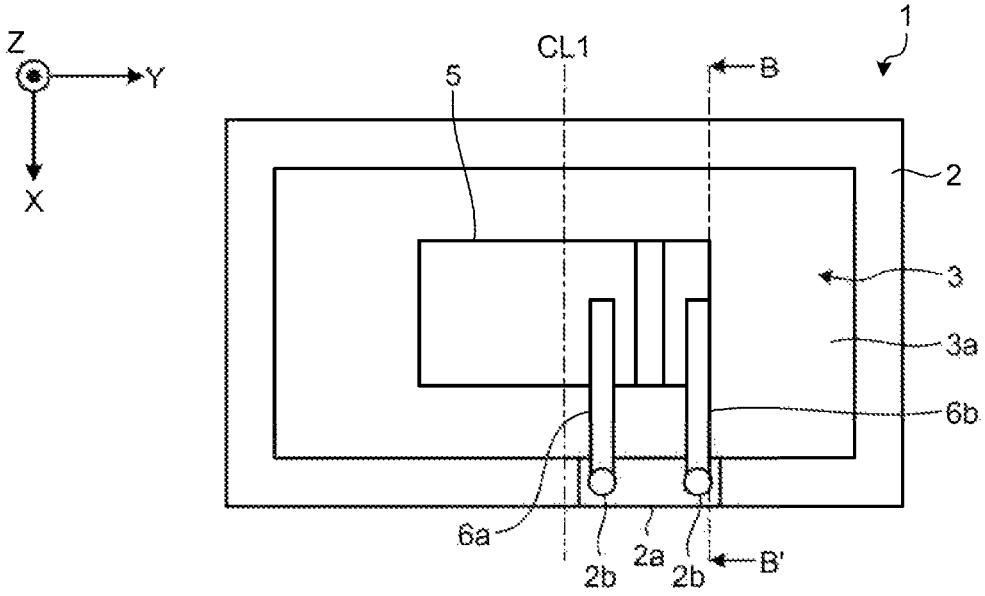
FIG. 3B is a second schematic plan view illustrating an example of the structure of the acoustic generator according to one embodiment.
Figure 3C:
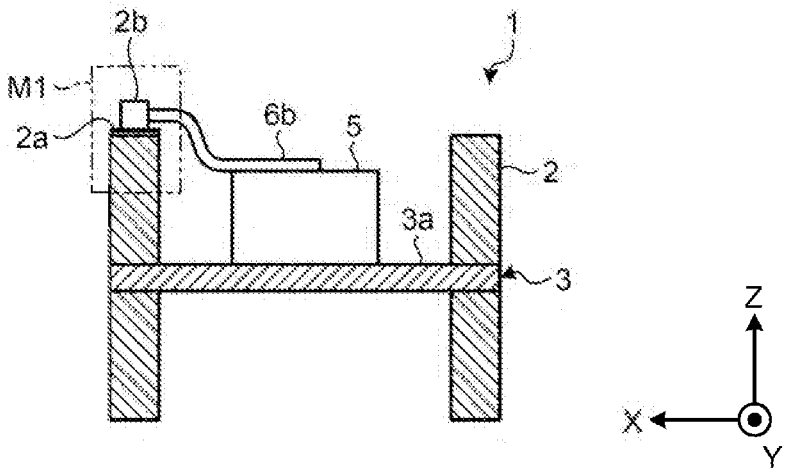
FIG. 3C is a cross sectional view along the line B-B' in FIG. 3B.

The acoustic generator 1 according to one embodiment will be specifically explained hereinafter with reference to FIG. 3A to FIG. 5J successively. First of all, FIG. 3A is a first schematic plan view illustrating an example of a structure of the acoustic generator 1 according to one embodiment. FIG. 3B is a second schematic plan view illustrating an example of the structure of the acoustic generator 1 according to one embodiment. FIG. 3C is a cross sectional view along the line B-B' in FIG. 3B.

The resin layer 7 may be omitted in the following drawings including the schematic plan views of FIG. 3A and FIG. 3B, in the same manner as FIG. 1A, for the sake of convenience of explanation.

As illustrated in FIG. 3A, the acoustic generator 1 includes terminals 2*b* in addition to the components of the acoustic generator 1' illustrated in FIG. 1A to FIG. 1C. The terminals 2*b* are electrode terminals serving as connecting points from the outside. The frame 2 is provided with one or more terminals 2*b*. FIG. 3A illustrates an example where the frame 2 is provided with a plurality of (two in this example) terminals 2*b*. This structure further distributes the degenerate vibration mode, and further smoothens the peak shape of the sound pressure at the resonance frequency.

When a plurality of terminals 2*b* are provided, it is more effective that at least one of the terminals 2*b* has a polarity different from the polarity of the other terminals 2*b*. Specifically, because the terminals 2*b* having different polarities have different signal components, the temperatures around the respective terminals 2*b* increase differently from each other. This structure enables further disturbance of the transmitted vibrating waves, and consequently causes the resonance frequency to become partly uneven.

Because the terminals 2*b* are connected to the piezoelectric element 5 through the lead wires 6*a* and 6*b*, the terminals 2*b* can collect vibration around the piezoelectric element 5 via the lead wires 6*a* and 6*b*. With this structure, the vibrating waves can be further effectively disturbed around the terminals 2*b*.

The terminals 2*b* are preferably provided to the frame 2, for example, with an intermediate layer 2*d* interposed therebetween. In one case where the frame 2 is formed of a metallic material, each of the terminals 2*b* includes, for example, a portion serving as a connecting point and formed of a metallic material, and a portion contacting the frame 2 and formed of an insulating material, and mounted to the frame 2 with the intermediate layer 2*d* interposed therebetween.

Figure 3D:
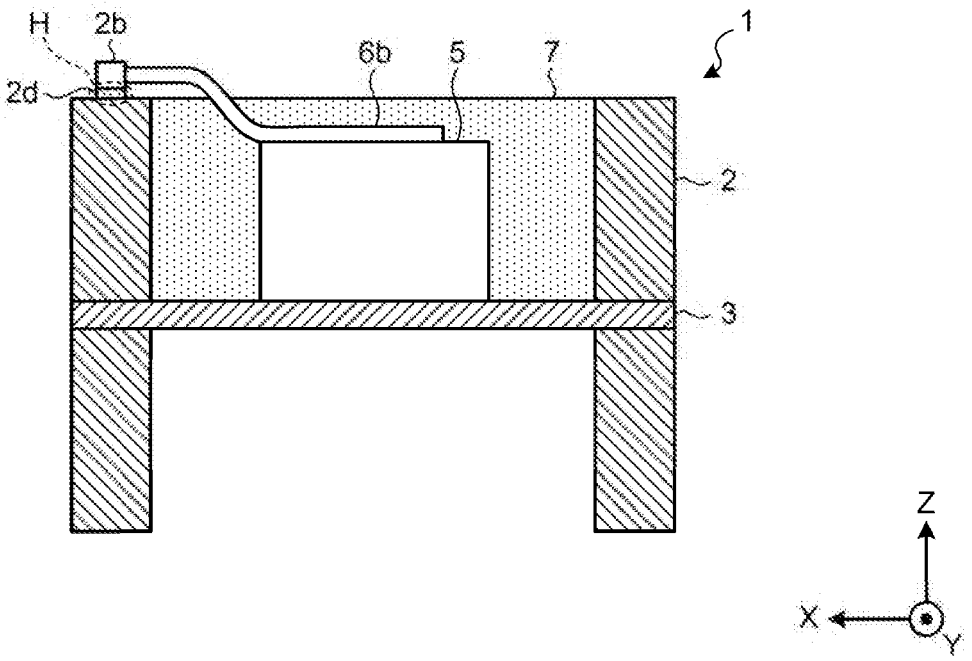
FIG. 3D is a cross sectional view along the line C-C' illustrating a modification of FIG. 3A.
Figure 3E:
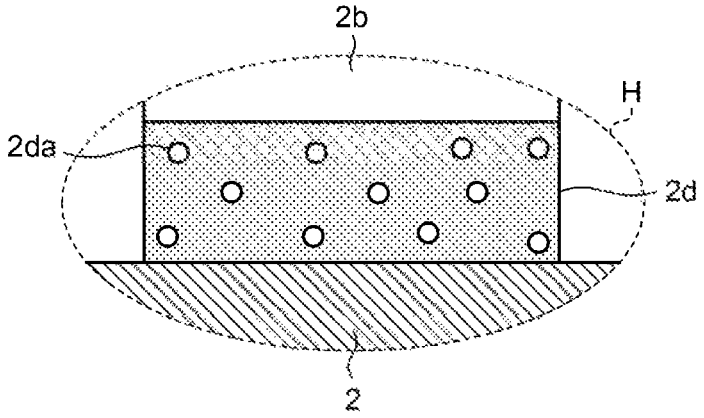
FIG. 3E is an enlarged view of part H illustrated in FIG. 3D.

This point will be explained hereinafter with reference to FIG. 3D and FIG. 3E. FIG. 3D is a cross sectional view along the line C-C' in FIG. 3A, and FIG. 3E is an enlarged view of part H illustrated in FIG. 3D.

As illustrated in FIG. 3D, the terminals 2*b* are fixed to the principal surface of the frame 2 with the intermediate layer 2*d* interposed between them. The terminals 2*b* are connected with the other ends of the lead wires 6*a* and 6*b*, respectively.

The intermediate layer 2*d* is, for example, an adhesive, and serves as a member having a Young's modulus (E) lower than that of the frame 2. As described above, in the first embodiment, the terminals 2*b* are fixed to the frame 2 with the intermediate layer 2*d* having a Young's modulus (E) lower than that of the frame 2 and interposed between them. A material having a low Young's modulus (E) generally has a small mechanical Q value, that is, has a large mechanical loss. For this reason, such intermediate layer 2*d* provided absorbs vibration of the frame 2, and further disturbs vibration of the frame 2 in portions where the terminals 2*b* are provided. This structure enables further flattening of the sound pressure, and further improvement in sound quality. In addition, vibration of the frame 2 is attenuated when transmitted to the terminals 2*b*. This structure produces the effect of reducing deterioration due to vibration of the terminals 2*b*, and improving durability.

In the case where both the frame 2 and the terminals 2*b* are formed of metal, the intermediate layer 2*d* desirably has insulating property. Vibration of the frame 2 can be more disturbed while insulation between the frame 2 and the terminals 2*b* are secured, by fixing the terminals 2*b* to the frame 2 with the insulating intermediate layer 2*d* interposed between them as described above.

The intermediate layer 2*d* may have a structure having three layers formed of, for example, an adhesive, an insulating layer, and an adhesive. When the portion of the terminals 2*b* contacting the frame 2 or the frame 2 is formed of an insulating material such as a resin, the intermediate layer 2*d* does not necessarily have insulating property.

In addition, as illustrated in FIG. 3E, the intermediate layer 2*d* preferably includes pores 2*da* inside, that is, voids.

Because regions having different Young's moduli are scattered in the intermediate layer 2*d* by providing pores 2*da* in the intermediate layer 2*d*, the resonance energy is absorbed in the regions, and the peak shape of the sound pressure at the resonance frequency is caused to become gentle. As a result, the difference between the resonance peak and the dip is reduced in the sound pressure frequency characteristics, and the frequency characteristics can be flattened. The pores 2*da* preferably have a spherical shape to easily absorb stress and the resonance energy from all the directions in the intermediate layer 2*d*.

The terminals 2*b* may be fixed to any of the external side surfaces of the frame 2, the principal surface of the frame 2 on the side where the piezoelectric element 5 is provided to the vibrating portion 3*a* and on the opposite side. In particular, the piezoelectric element 5 is preferably fixed to the principal surface of the frame 2 on the side where the piezoelectric element 5 Is provided. This structure enables suppression of the resonance of the frame 2 caused by vibration generated from the piezoelectric element 5 and transmitted in the air, and improvement in sound quality.

The terminals 2*b* are disposed on the same side as the other constituent elements such as the piezoelectric element 5 and the resin layer 7 with respect to the vibrating surface of the vibrating portion 3*a*. This structure produces the effect of reducing the symmetry of the whole composite vibrating portion with respect to the vibrating surface of the vibrating portion 3*a*, and distributing the resonance frequency of the whole composite vibrating portion.

As illustrated in FIG. 3D, the lead wires 6*a* and 6*b* are preferably connected in a loose state between the terminals 2*b* and the piezoelectric element 5. Because this structure enables attenuation of vibration transmitted from the terminals 2*b* to the piezoelectric element 5, this structure enables reduction in noise transmitted to the piezoelectric element 5 serving as the vibrating source, and generation of clear sound with high sound quality. Because this structure also enables suppression of stress on the terminals 2*b* and the piezoelectric element 5, this structure improves durability, and extends the life of the product.

The terminals 2*b* are preferably formed of a material softer than, that is, having a smaller elasticity than the material of the frame 2, from the viewpoint of suppressing generation of noise. This structure enables attenuation of vibration generated in the frame 2, and also enables reduction in noise transmitted to the piezoelectric element 5.

Each of the terminals 2*b* may be provided with a hole portion such as a through hole. The terminals 2*b* each provided with such a hole portion are capable of distributing the degenerate vibrating mode of the frame 2, further disturbing vibration of the frame 2 in the hole portion, and disturbing reflected waves to the vibrating portion 3*a*. This structure enables smoothing the peak shape of the sound pressure of the whole composite vibrating portion at the resonance frequency.

As illustrated in FIG. 3B, the terminals 2*b* may be provided to the frame 2 with a terminal plate 2*a* interposed between them. The terminal plate 2*a* is a substrate provided to the frame 2. A glass epoxy substrate or the like may be preferably used as the terminal plate 2*a*.

At least one terminal 2*b* is provided on the terminal plate 2*a* as described above. FIG. 3 illustrates an example of the case where two terminals 2*b* are provided on the terminal plate 2*a*, but the example does not limit the number of the terminals 2*b* per terminal plate 2*a*.

Figure 4A:
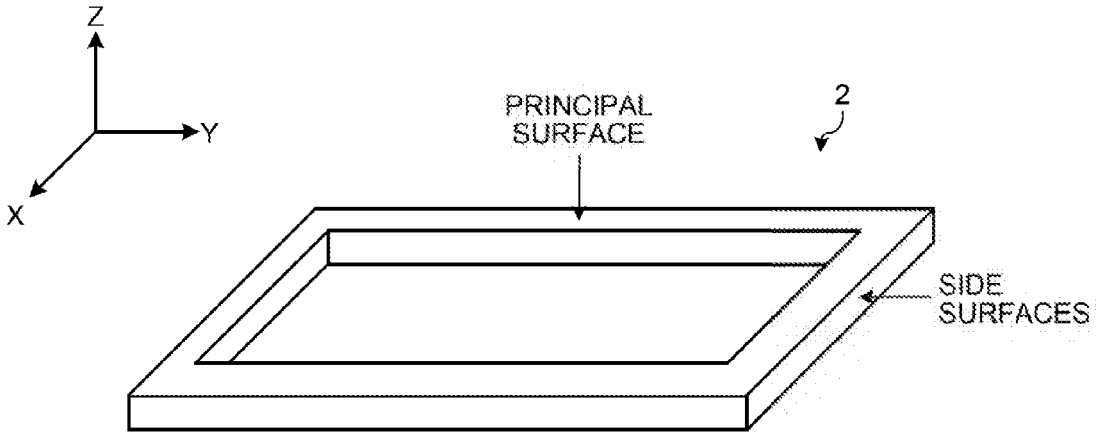
FIG. 4A is a schematic perspective view for explaining portions of a frame member.
Figure 4B:
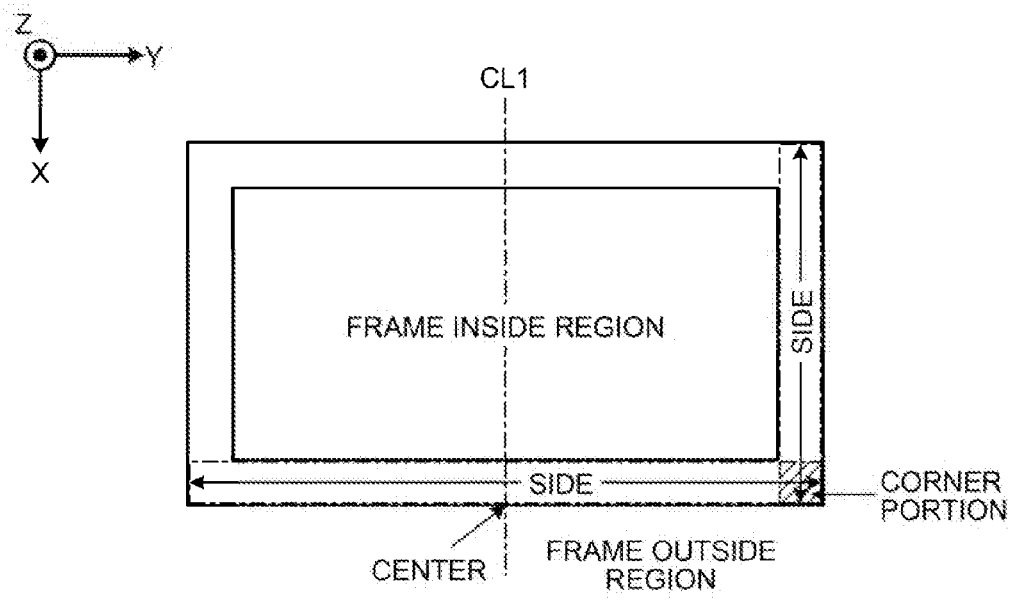
FIG. 4B is a schematic plan view for explaining the portions of the frame member.

The names of the portions of the frame 2 in the present embodiment will be described hereinafter with reference to FIG. 4A and FIG. 4B, from the viewpoint of facilitating understanding of the following explanation. FIG. 4A is a schematic perspective view for explaining portions of the frame 2, and FIG. 4B is a schematic plan view for explaining the portions of the frame 2. FIG. 4A illustrates only one of the two frame members forming the frame 2.

As illustrated in FIG. 4A, in the present embodiment, end surfaces that are parallel with the XY plane in the end surfaces of the frame 2 are expressed as "principal surfaces". End surfaces that are parallel with the XZ plane or the YZ plane in the end surfaces of the frame 2 are expressed as "side surfaces".

As illustrated in FIG. 4B, in the present embodiment, the ribs in the longitudinal direction or the short length direction are expressed as "sides". The portions in each of which a side and a side overlap each other are expressed as "corner portions" (see the diagonal region covered with diagonal lines in FIG. 4B).

The portion where the center line CL1 of the frame 2 and the "side" cross each other is expressed as "center". FIG. 4B illustrates only the "center" where the side crosses the longitudinal center line CL1, but the expression is also applicable to that in the short length direction.

FIG. 4B illustrates an example of the case where the frame 2 has a substantially rectangular shape formed of only "sides" having a straight-line shape, but the "sides" may have a curved shape as long as each of the sides is a rib having both ends.

As illustrated in FIG. 4B, in the present embodiment, the region inside she frame 2 is expressed as "frame inside region", and the region outside the frame 2 is expressed as "frame outside region".

With reference to FIG. 3A and FIG. 3B again, the acoustic generator 1 according to one embodiment will be explained in detail. As illustrated in FIG. 3A and FIG. 3B, in the present embodiment, the terminals 2*b* described above are provided to the principal surface of the frame 2, to be shifted from the center of the frame 2. In relation to this, the terminal plate 2*a* is provided to be shifted from the center of the sides of the frame 2 toward the corner portion of the frame 2.

First of all, the effect obtained by the above structure will be explained hereinafter with respect to the terminals 2*b*. It has been already explained that the frame 2 itself also vibrates, being induced by the resonance of the vibrating portion 3*a*. Because the frame 2 having the above structure is provided with the terminals 2*b*, the vibrating waves transmitted through the frame 2 can be disturbed around the terminals 2*b*.

In particular, when an electrical signal is input to the terminals 2*b*, because the temperature around the terminals 2*b* partly increases, thermal expansion is caused to easily disturb the vibrating waves. This structure enables disturbance of the reflected waves returned from the frame 2 to the vibrating portion 3*a*.

As a result, because the resonance frequency is caused to become partly uneven, the peak P of the sound pressure of the resonance point is varied, and the sound pressure frequency characteristics can be flattened. Specifically, excellent sound pressure frequency characteristics can be obtained.

Because the terminals 2*b* are provided on the principal surface side of the frame 2 serving as the side on which the sound generated by the acoustic generator 1 is transmitted, the vibrating waves induced by the sound signal are caused to easily vibrate the terminals 2*b*.

Accordingly, the transmitted vibrating waves are caused to be easily disturbed around the terminals 2*b*, and consequently the resonance frequency is caused to be partly uneven. Specifically, the peak P of the sound pressure of the resonance point is varied, and excellent sound pressure frequency characteristics can be obtained.

Because the terminals 2*b* are provided to be shifted from the center of the frame 2, the shape of the whole composite vibrating portion can be caused to become asymmetrical. This structure enables disturbance of the reflected waves from the frame 2 to the vibrating portion 3*a*, and reduction in symmetry of the reflected waves.

This structure also causes the resonance frequency to be partly uneven, and varies the peak P of the sound pressure of the resonance point, to obtain excellent sound pressure frequency characteristics.

Then, the effect produced by the terminal plate 2*a* will be explained hereinafter. The terminal plate 2*a* is provided to the frame 2, to cause the vibrating waves transmitted through the surface of the frame 2 to be reflected by a portion where the terminal plate 2*a* exists.

Specifically, the terminal plate 2*a* causes the resonance frequency to be partly uneven, and varies the peak P of the sound pressure of the resonance point, to obtain excellent sound pressure frequency characteristics.

In particular, when a glass epoxy substrate is used for the terminal plate 2*a* as described above, the terminal plate 2*a* can strongly disturb the vibrating waves around the terminal plate 2*a*, because the terminal plate 2*a* has a structure in which materials having different Young's moduli are scattered. This structure is more effective in causing the resonance frequency to be partly uneven.

Because the terminal plate 2*a* is provided to be shifted from the center of the side the frame 2 toward the corner portion of the frame 2, the shape of the whole composite vibrating portion can be caused to become asymmetrical. This structure enables disturbance of the reflected waves from the frame 2 to the vibrating portion 3*a*, and reduction in symmetry of the reflected waves. In this manner, the resonance frequency can be caused to be partly uneven. Specifically, this structure also varies the peak P of the sound pressure of the resonance point, to obtain excellent sound pressure frequency characteristics.

As illustrated in FIG. 3B, the terminal plate 2*a* is preferably provided between the corner portion of the frame 2 and the center of the side of the frame 2. In this case, the reflected waves from the frame 2 to the vibrating portion 3*a* can be disturbed more effectively, because the shape of the whole composite vibrating portion can be caused to become asymmetrical, while avoiding the corner portion where two sides cross each other and thus having high rigidity (that is, hard to vibrate).

Based on the above, the terminal plate 2*a* is preferably provided in the longitudinal side of the frame 2. With this structure, the symmetry of the reflected waves can be more reduced than the case of providing the terminal plate 2*a* in the shorter side, and the resonance frequency can be caused to be partly uneven more effectively.

The effects produced by the terminal plate 2*a* and the terminals 2*b* can be obtained synergistically, by providing the terminals 2*b* onto the terminal plate 2*a* as described above. Specifically, this structure enables varying the peak P of the sound pressure of the resonance point more effectively, to obtain excellent sound pressure frequency characteristics.

In the case where a plurality of (two in this example) terminals 2*b* are provided as illustrated in FIG. 3A, the terminals 2*b* are capable of having respective resonance peaks different from each other, and further disturbing the vibrating waves around the terminals 2*b*. This structure also causes the resonance frequency to be partly uneven.

Also in the case of providing a plurality of terminals 2*b*, it is more effective that at least one terminal 2*b* has a polarity different from a polarity of the other terminals 2*b*. Specifically, because the terminals 2*b* having different polarities have respective signal components different from each other, the temperatures around the respective terminals 2*b* increase differently from each other. This structure enables further disturbance of the vibrating waves transmitted through the terminal plate 2*a*, and thus causes the resonance frequency to be partly uneven.

In addition, the terminals 2*b* are capable of collecting vibrations around the piezoelectric element 5 via the lead wires 6*a* and 6*b*, because the terminals 2*b* are connected to the piezoelectric element 5 via the lead wires 6*a* and 6*b*. This structure enables further disturbance of the vibrating waves effectively around the terminals 2*b*.

As illustrated in FIG. 3*c*, the lead wires 6*a* and 6*b* (6*a* is not illustrated) are preferably connected in a loose state between the terminals 2*b* and the piezoelectric element 5. With this structure, because vibration from the terminals 2*b* to the piezoelectric element 5 can be attenuated, generation of noise is suppressed, and clear sound with high sound quality can be generated. This structure also improves durability, and extends the life of the product, because the structure suppresses stress on the terminals 2*b* and the piezoelectric element 5.

The terminals 2*b* are preferably formed of a material softer than the material of the frame 2, from the viewpoint of suppressing generation of noise. This structure enables attenuation of vibration generated in the frame 2, and also enables reduction in noise.

As illustrated in FIG. 3A and FIG. 3B, the terminals 2*b* are provided so as not to project into the frame outside region or the frame inside region of the frame 2, to control the degree of freedom of vibration of the terminals 2*b* themselves. This structure enables suppression of sounding from the terminals 2*b*, and also suppression of generation of noise.

Conversely, the terminals 2*b* may be provided to project into the frame outside region or the frame inside region of the frame 2. This point will be explained later with reference to FIG. 5B. The part M1 enclosed by a two-dot chain line in FIG. 3C will be illustrated again as an enlarged view in the explanation with reference to FIG. 5F.

Then, modifications of the terminal plate 2*a* or the terminals 2*b* will be successively explained hereinafter, with reference to FIG. 5A to FIG. 5J. FIG. 5A to FIG. 5D and FIG. 5H to FIG. 5J are first to seventh schematic plan views successively illustrating modifications of the terminal plate 2*a* or the terminals 2*b*. FIG. 5E is a schematic perspective view illustrating one of modifications of the terminal plate 2*a*. FIG. 5F is a schematic cross sectional view illustrating one of modifications of the terminals 2*b*, and FIG. 5G is a cross sectional view along the line B-B' illustrating a modification of FIG. 3B.

Figure 5A:
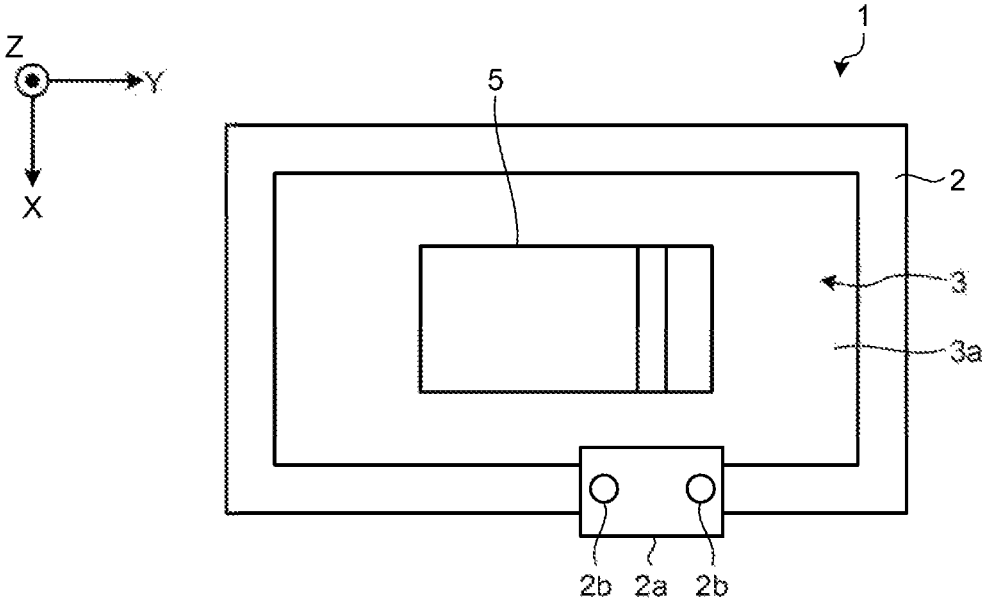
FIG. 5A is a first schematic plan view illustrating a modification of a terminal plate or terminals.

First of all, as illustrated in FIG. 5A, the terminal plate 2*a* may be provided to project into the frame outside region or the frame inside region of the frame 2. In such a case, because the resonance frequency is shifted in the projecting portion of the terminal plate 2*a* even when the frame 2 vibrates due to induction by vibration of the vibrating portion 3*a*, the vibrating waves of the frame 2 that is transmitted around the terminals 2*b* can be further disturbed. As a result, the reflected waves from the frame 2 to the vibrating portion 3*a* can be further disturbed.

Specifically, the resonance frequency is caused to be partly uneven, and the peak P of the sound pressure of the resonance point is varied, to obtain excellent sound pressure frequency characteristics.

Figure 5B:
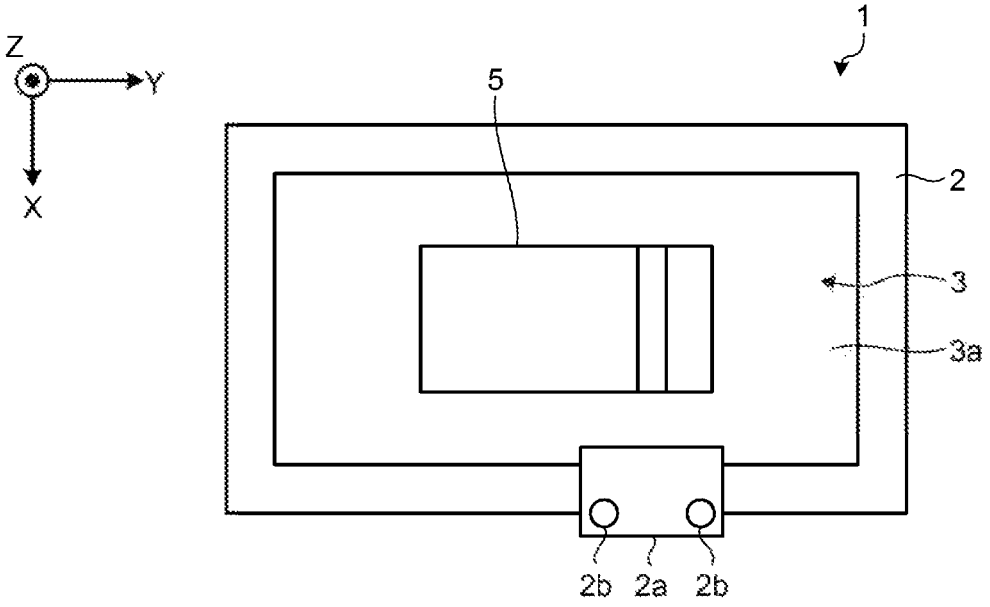
FIG. 5B is a second schematic plan view illustrating a modification of the terminal plate or the terminals.

FIG. 5A illustrates an example of the case where the terminals 2*b* are provided on the terminal plate 2*a* so as to be located in the principal surface of the frame 2, but the terminals 2*b* may be provided at positions where the terminals 2*b* project into the frame outside region or the frame inside region of the frame 2, as illustrated in FIG. 5B. Also in this case, for the same reason as that in the case of FIG. 5A, the resonance frequency is caused to be partly uneven, and the peak P of the sound pressure of the resonance point is varied, to obtain excellent sound pressure frequency characteristics.

Figure 5C:
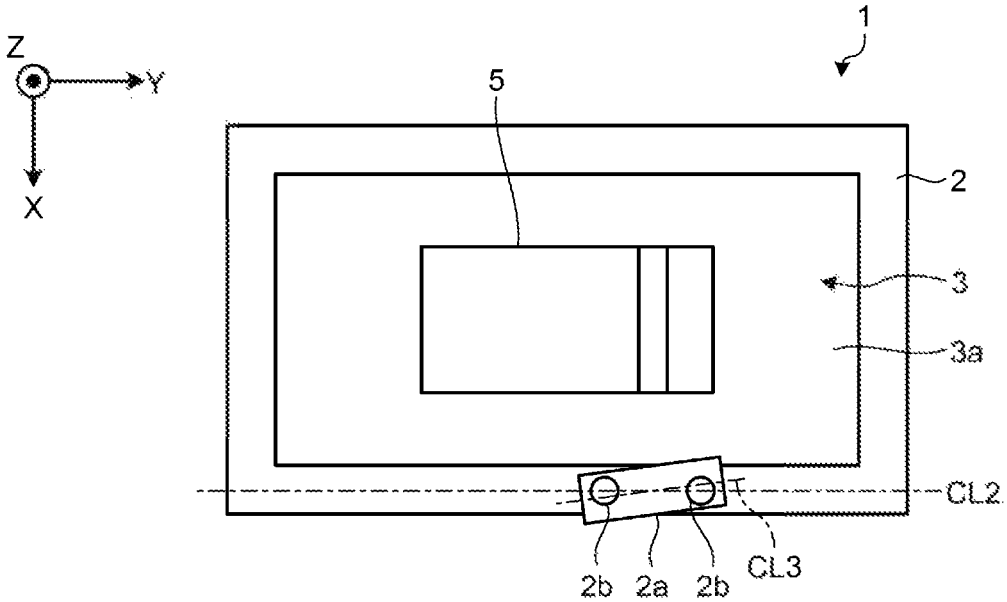
FIG. 5C is a third schematic plan view illustrating a modification of the terminal plate or the terminals.

As illustrated in FIG. 5C, the terminal plate 2*a* may be provided to be nonparallel with the side of the frame 2 in plan view. Specifically, the center line CL2 of the side of the frame 2 is nonparallel with the center line CL3 of the terminal plate 2*a* in plan view.

In such a case, the resonance frequency is further shifted in the region of the terminal plate 2*a* even when the frame 2 vibrates due to induction by vibration of the vibrating portion 3*a*, because the terminal plate 2*a* is nonparallel with the frame 2. With this structure, the vibrating waves of the frame 2 that is transmitted around the terminals 2*b* can be further disturbed, and consequently the reflected waves from the frame 2 to the vibrating portion 3*a* can be further disturbed.

Specifically, the resonance frequency is caused to be partly uneven, and the peak P of the sound pressure of the resonance point is varied, to obtain excellent sound pressure frequency characteristics.

The nonparallel structure as described above causes the shape of the composite vibrating portion to become asymmetrical. Specifically, the symmetry of the reflected waves is reduced, to cause the resonance frequency to be partly uneven.

Figure 5D:
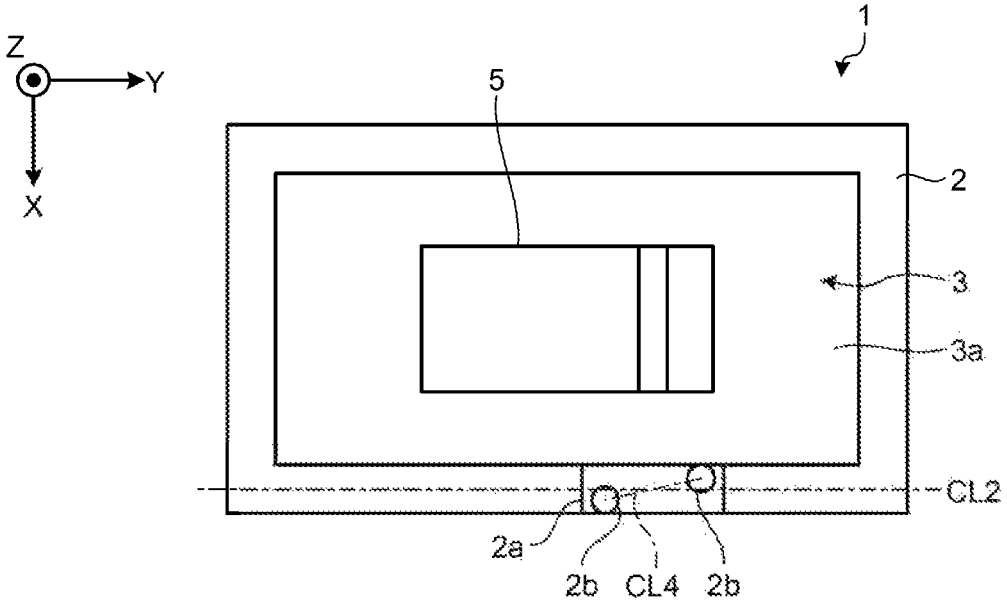
FIG. 5D is a fourth schematic plan view illustrating a modification of the terminal plate or the terminals.
Figure 5E:
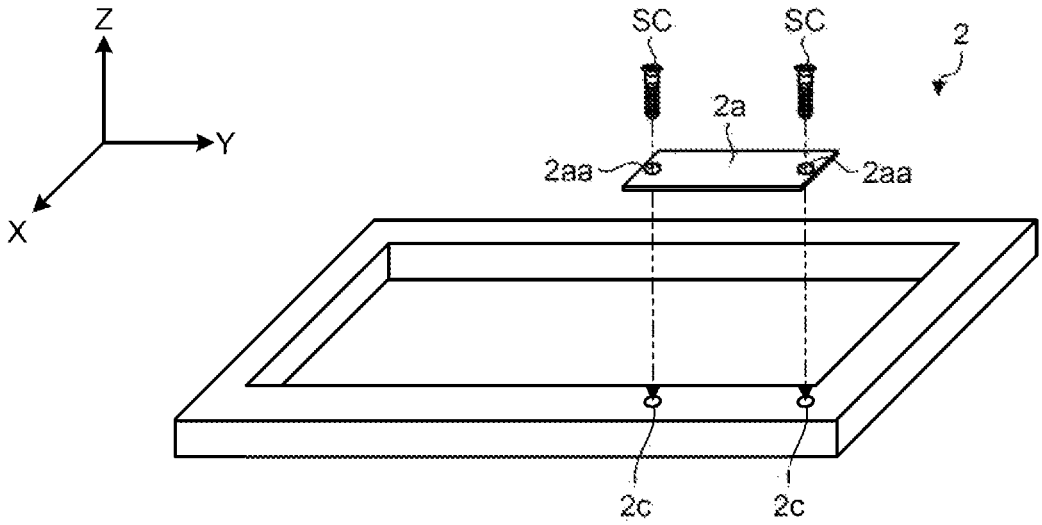
FIG. 5E is a schematic perspective view illustrating one of modifications of the terminal plate.
Figure 5F:
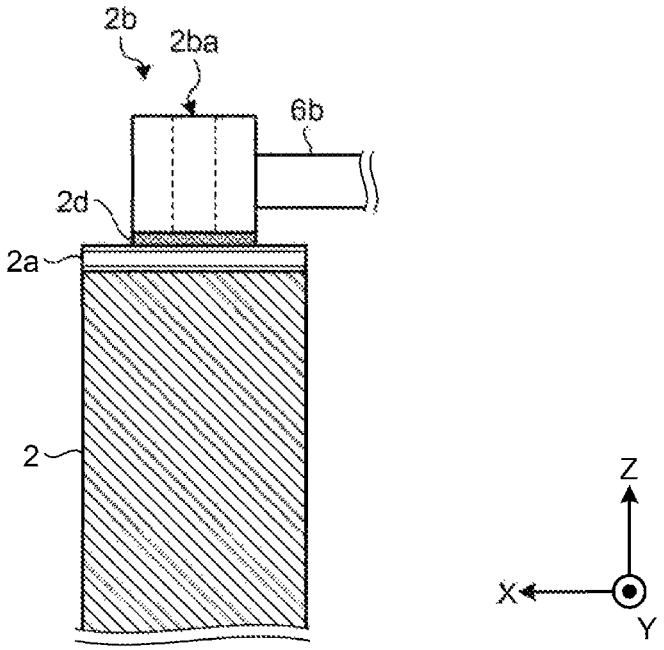
FIG. 5F is a schematic cross sectional view illustrating one of modifications of the terminal.
Figure 5G:
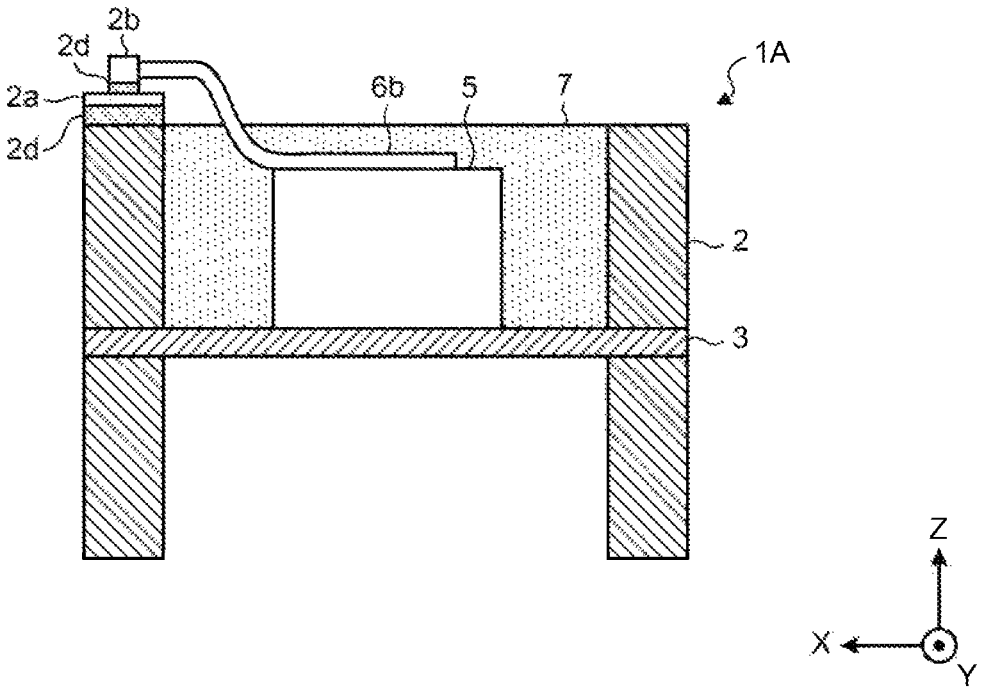
FIG. 5G is a cross sectional view along the line B-B' illustrating a modification of FIG. 3B.

In relation to this, the terminals 2*b* may be provided to be nonparallel with the side of the frame 2 in plan view, as illustrated in FIG. 5D. Specifically, the line CL4 connecting the two terminals 2*b* is nonparallel with the center line CL2 of the side of the frame 2 in plan view.

Also in this case, for the same reason as that in the case of FIG. 5C, the resonance frequency is caused to be partly uneven, and the peak P of the sound pressure of the resonance point is varied, to obtain excellent sound pressure frequency characteristics.

As illustrated in FIG. 5E, the terminal plate 2*a* may be provided with hole portions 2*aa*. For example, FIG. 5E illustrates the case where the terminal plate 2*a* is provided with the hole portions 2*aa* serving as screw holes for screws SC, and the terminal plate 2*a* is attached to the frame 2 by fastening the hole portions 2*aa* with screws to screw holes 2*c* provided in the frame 2. For example, the screws SC may also serve as the terminals 2*b*.

In relation to the example illustrated in FIG. 5E, each of the terminals 2*b* may be provided with a hole portion 2*ba*, as illustrated in FIG. 5E. In the case of providing the terminal plate 2*a* or the terminals 2*b* with holes such as the hole portions 2*aa* and the hole portions 2*ba* as described above, the reflected waves from the frame 2 to the vibrating portion 3*a* can be further disturbed, because vibrating waves can be formed inside the holes in response to vibration.

In the case where a joint exists between the hole and a counterpart member (for example, the frame 2), the joint can further disturb the vibrating waves and the reflected waves thereof. In addition, because the circumference of the hole can be deformed with high sound pressure, such a structure is more effective for disturbing the waves and causing the resonance frequency to be partly uneven.

As illustrated in FIG. 5F, the terminals 2*b* are preferably bonded to the terminal plate 2*a* using the intermediate layer 2*d* (bonding material such as an adhesive). In such a case, because each of the terminals 2*b* and the intermediate layer 2*d* disturbs the vibrating waves of the frame 2, the vibrating waves around the terminals 2*b* can be strongly disturbed synergistically. Specifically, this structure is also more effective in causing the resonance frequency to be partly uneven.

When the terminal plate 2*a* has insulating property, the intermediate layer 2*d* does not necessarily have insulating property. Specifically, the intermediate layer 2*d* that is conductive may be used. When the intermediate layer 2*d* has insulating property, the terminal plate 2*a* does not necessary have insulating property. For example, the terminal plate 2*a* formed of metal may be used. Specifically, at least one of the intermediate layer 2*d* and the terminal plate 2*a* should have insulating property. For this reason, the intermediate layer 2*d* may be a member such as a washer, as well as an adhesive. As illustrated in FIG. 5G, the terminal plate 2*a* as well as the terminals 2*b* may be bonded to the frame 2 using the intermediate layer 2*d*.

Although the terminal plate 2*a* is preferably provided between the corner portion of the frame 2 and the center of the side of the frame 2 in the explanation with reference to FIG. 3B, the embodiment is not limited thereto.

Figure 5H:
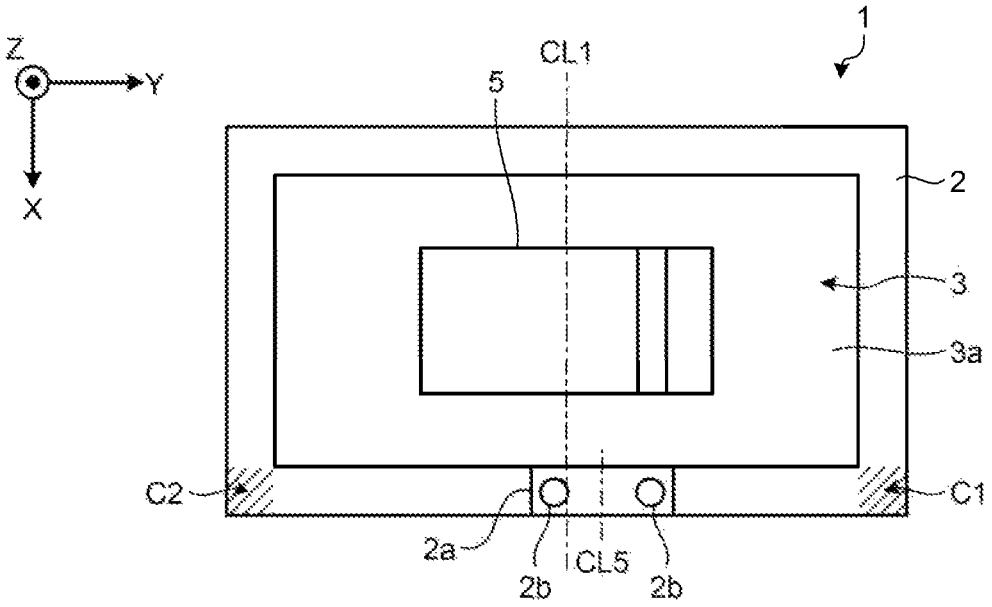
FIG. 5H is a fifth schematic plan view illustrating a modification of the terminal plate or the terminals.

For example, as illustrated in FIG. 5H, the terminal plate 2*a* may overlap the center of the frame 2 with respect to the center line CL1. Specifically, even when the terminal plate 2*a* overlaps the center of the frame 2, it suffices that the center line CL5 of the terminal plate 2*a* is shifted from the center of the frame 2 toward the corner portion C1 or the corner portion C2.

This structure can also at least cause the shape of the whole composite vibrating portion to be asymmetrical, and reduces and disturbs the symmetry of the reflected waves from the frame 2 to the vibrating portion 3*a*. The structure is more effective when at least the terminals 2*b* are also provided to be shifted from the center of the frame 2, as illustrated in FIG. 5H.

Figure 5I:
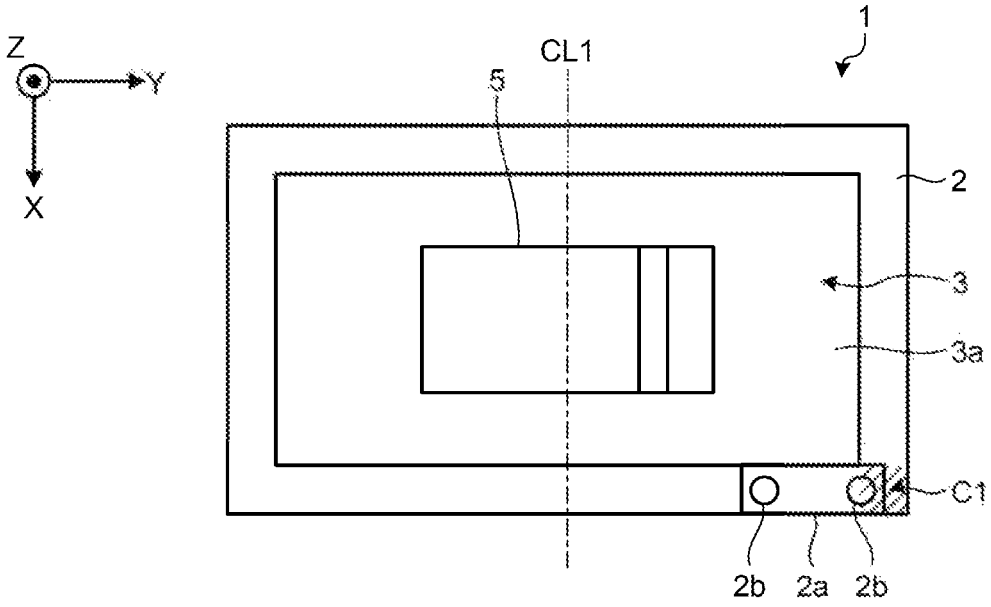
FIG. 5I is a sixth schematic plan view illustrating a modification of the terminal plate or the terminals.

As illustrated in FIG. 5I, the terminal plate 2*a* may be provided to overlap the corner portion (corner portion C1 in this example) of the frame 2. This structure can also at least cause the shape of the whole composite vibrating portion to be asymmetrical, in the same manner as in the case of FIG. 5H, and reduces and disturbs the symmetry of the reflected waves from the frame 2 to the vibrating portion 3*a*.

Figure 5J:
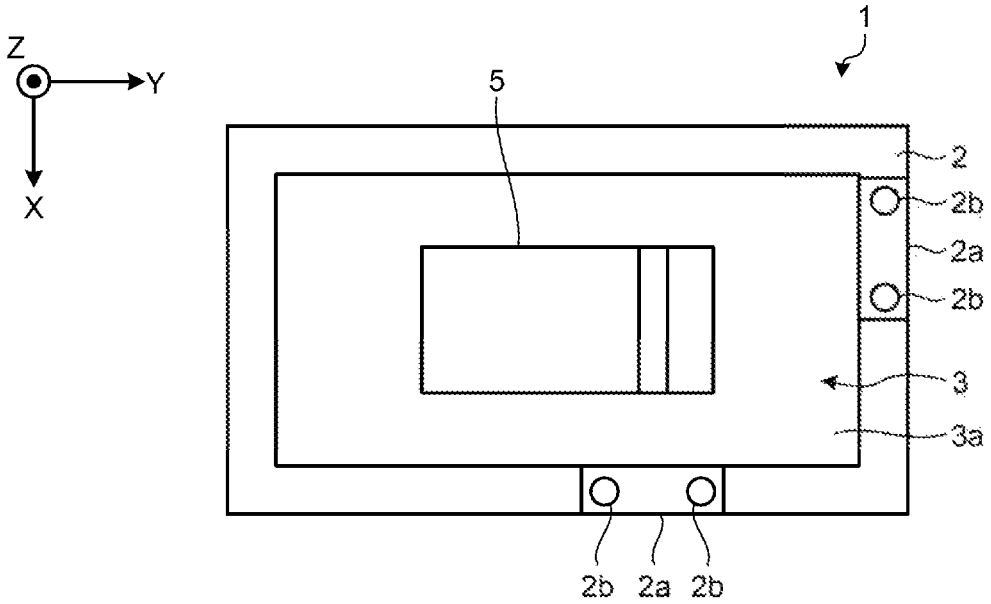
FIG. 5J is a seventh schematic plan view illustrating a modification of the terminal plate or the terminals.

As illustrated in FIG. 5J, a plurality of terminal plates 2*a* may be provided, as well as the terminals 2*b*. In this case, the second terminal plate 2*a* and subsequent terminal plates 2*a* may be provided as dummies that do not conduct electrical signals.

The terminal plates 2*a* and the terminals 2*b* provided in plurality as dummies on the frame 2 can cause disturbance of the reflected waves from the frame 2 to the vibrating portion 3*a*.

Figure 6A:
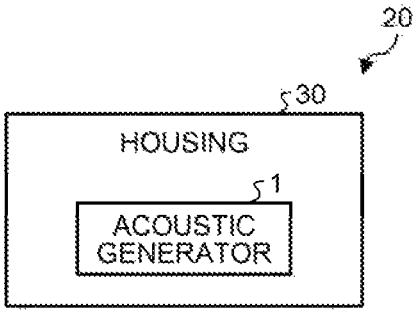
FIG. 6A is a diagram illustrating a configuration of the acoustic generation device according to one embodiment.
Figure 6B:
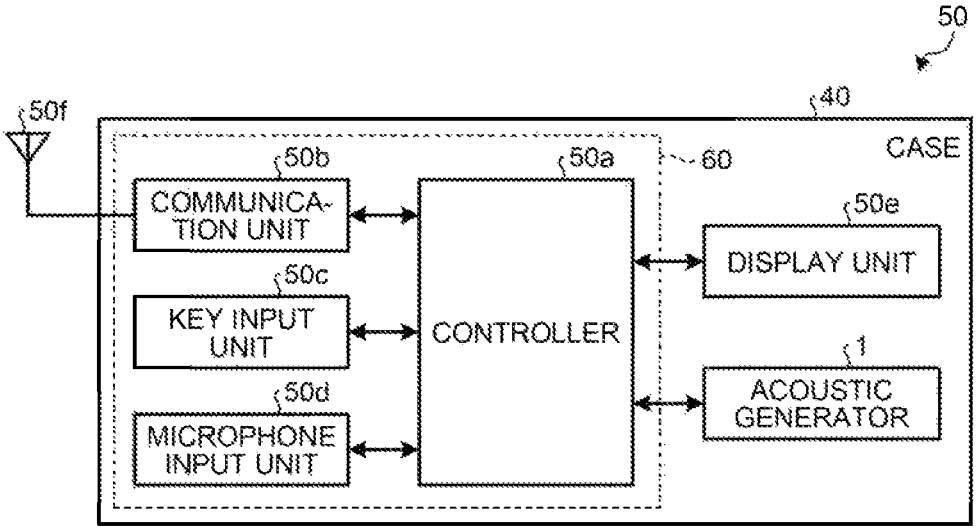
FIG. 6B is a diagram illustrating a configuration of an electronic device according to one embodiment.

An acoustic generation device and an electronic device equipped with the acoustic generator 1 according to the embodiment described above will now be described with reference to FIG. 6A and FIG. 6B. FIG. 6A is a diagram illustrating a configuration of an acoustic generation device 20 according to one embodiment, and FIG. 6B is a diagram illustrating a configuration of an electronic device 50 according to one embodiment. These diagrams illustrate only the components required for description and do not illustrate general components.

The acoustic generation device 20 is a sound generating device such as a speaker and includes, for example, the acoustic generator 1 and a housing 30 for accommodating the acoustic generator 1, as illustrated in FIG. 6A. The housing 30 resonates sound produced by the acoustic generator 1 in the inside and emits the sound from a not-illustrated opening defined in the housing 30 to the outside. The provision of this housing 30 can enhance the sound pressure, for example, in a low frequency band.

The acoustic generator 1 may be installed in different types of electronic devices 50. For example, in FIG. 6B described below, the electronic device 50 is explained to be a mobile electronic device, such as a mobile phone or a tablet terminal.

As illustrated in FIG. 6B, the electronic device 50 includes an electronic circuit 60. The electronic circuit 60 includes, for example, a controller 50*a*, a communication unit 50*b*, a key input unit 50*c*, and a microphone input unit 50*d*. The electronic circuit 60 is connected to the acoustic generator 1, and serves to output an audio signal to the acoustic generator 1. The acoustic generator 1 generates sound based on the audio signal received from the electronic circuit 60.

The electronic device 50 also includes a display unit 50*e*, an antenna 50*f*, and the acoustic generator 1. The electronic device 50 also includes a case 40 in which these devices are housed.

Although FIG. 6B represents a state in which all of the devices including the controller 50*a* are accommodated in a single case 40, the manner in which the devices are accommodated is not limited to this example. In the present embodiment, at least the electronic circuit 60 and the acoustic generator 1 are accommodated in the single case 40.

The controller 50*a* is a control unit for the electronic device 50. The communication unit 50*b* exchanges data, for example, via the antenna 50*f*, based on the control of the controller 50*a*.

The key input unit 50*c* is an input device for the electronic device 50, and receives operations of key inputs performed by an operator. The microphone input unit 50*a* is also an input device for the electronic device 50, and receives operations of voice inputs of an operator.

The display unit 50*e* is a display output device for the electronic device 50, and outputs information to be displayed based on the control of the controller 50*a*.

The acoustic generator 1 operates as a sound output device in the electronic device 50. The acoustic generator 1 is connected to the controller 50*a* in the electronic circuit 60, and receives an application of a voltage controlled by the controller 50*a* and outputs sound.

Explained with reference to FIG. 6B is an example in which the electronic device 50 is a mobile electronic device, but the type of the electronic device 50 is not limited thereto, and may be used in various types of consumer devices having a function of generating sound. The electronic device 50 may be a flat television or a car stereo system, for example, and may be used in various types of products with a function outputting sound, such as those with a function of "speaking", examples of which include a vacuum cleaner, a washing machine, a refrigerator, and a microwave oven.

The acoustic generator according to the embodiment described above includes an exciter (piezoelectric element), a vibrating portion, a frame, and a lead (lead wire). The exciter receives an input of an electrical signal and is caused to vibrate. The exciter is mounted on the vibrating portion, and the vibrating portion is caused to vibrate by the vibration of the exciter. The frame is provided on an external circumferential portion of the vibrating portion, to support the vibrating portion substantially flat. The lead is connected to the exciter, and inputs an electrical signal to the exciter. The frame includes a terminal serving as a connection point to the lead.

The acoustic generator according to the embodiment enables obtaining excellent sound pressure frequency characteristics.

The above embodiment illustrates an example of the case of forming a resin layer to cover the piezoelectric element and the vibrating portion in the frame inside portion of the frame, the resin layer may not be necessarily formed.

The above embodiment illustrates an example of the case of forming the vibrating plate with a thin film such as a resin film, but the embodiment is not limited thereto. The vibrating plate may be formed of a plate-like member.

Furthermore, explained in the embodiment described above is an example in which the exciter is the piezoelectric element, but the exciter is not limited to a piezoelectric element, and may be any exciter having a function of receiving an electrical signal and causing vibration.

The exciter may be, for example, an electrodynamic exciter, an electrostatic exciter, or an electromagnetic exciter that are known exciters causing a speaker to vibrate.

An electrodynamic exciter applies a current to a coil positioned between magnetic poles of permanent magnets, and causes the coil to vibrate. An electrostatic exciter applies a bias and an electrical signal to two metal plates facing each other, and causes the metal plates to vibrate. An electromagnetic exciter supplies an electrical signal to a coil, and causes a thin steel sheet to vibrate.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

The invention claimed is:

1. An acoustic generator comprising:

an exciter that receives an input of an electrical signal and is caused to vibrate;

a vibrating portion on which the exciter is mounted and that is caused to vibrate by the vibration of the exciter;

a frame that is provided on an external circumferential portion of the vibrating portion, and supports the vibrating portion substantially flat; and a lead that is connected to the exciter, and inputs an electrical signal to the exciter, wherein the frame includes terminals serving as a connection point to the lead and provided on a side of a principal surface of the frame opposite to a surface where the vibrating portion is supported, such that a line connecting at least two of the terminals is nonparallel with the side in plan view.

2. The acoustic generator according to claim 1, wherein the terminal is formed of a material that is softer than a material of the frame.

3. The acoustic generator according to claim 1, wherein the terminal is provided to be shifted from center of a side of the frame.

4. The acoustic generator according to claim 1, wherein the terminal is provided via an intermediate layer.

5. The acoustic generator according to claim 4, wherein the intermediate layer includes pores.

6. The acoustic generator according to claim 1, wherein the vibrating portion is formed of a resin film.

7. The acoustic generator according to claim 1, wherein the exciter is a laminated bimorph piezoelectric element.

8. An acoustic generation device comprising:

the acoustic generator according to claim 1; and a housing that accommodates the acoustic generator.

9. An electronic device comprising:

the acoustic generator according to claim 1;

an electronic circuit that is connected to the acoustic generator; and a case that accommodates the electronic circuit and the acoustic generator, wherein the electronic device has a function of producing sound from the acoustic generator.

10. An acoustic generator comprising:

an exciter that receives an input of an electrical signal and is caused to vibrate;

a vibrating portion on which the exciter is mounted and that is caused to vibrate by the vibration of the exciter:

a frame that is provided on an external circumferential portion of the vibrating portion, and supports the vibrating portion substantially flat; and a lead that is connected to the exciter, and inputs an electrical signal to the exciter, wherein, the frame includes a substrate on a principal surface of the frame opposite to a surface where the vibrating portion is supported, and a terminal provided on the substrate and serving as a connection point to the lead, the substrate provided to the frame is provided to be shifted from center of a side of the frame toward a corner portion of the frame in plan view.

11. The acoustic generator according to claim 10, wherein the substrate is provided to be nonparallel with a side of the frame in plan view.

12. The acoustic generator according to claim 10, wherein the substrate is provided to project into a frame outside region or a frame inside region of the frame.

13. The acoustic generator according to claim 10, wherein the vibrating portion is formed of a resin film.

14. The acoustic generator according to claim 10, wherein the exciter is a laminated bimorph piezoelectric element.

15. An acoustic generation device comprising:

the acoustic generator according to claim 10: and a housing that accommodates the acoustic generator.

16. An electronic device comprising:

the acoustic generator according to claim 10:

an electronic circuit that is connected to the acoustic generator: and a case that accommodates the electronic circuit and the acoustic generator, whereby the electronic device produces sound from the acoustic generator.

* * * * *